US008414265B2

(12) United States Patent
Willett, Jr.

(10) Patent No.: US 8,414,265 B2
(45) Date of Patent: Apr. 9, 2013

(54) TURBINES AND TURBINE BLADE WINGLETS

(75) Inventor: Fred Thomas Willett, Jr., Burnt Hill, NY (US)

(73) Assignee: General Electric Company, Schenectady, NY (US)

( * ) Notice: Subject to any disclaimer, the term of this patent is extended or adjusted under 35 U.S.C. 154(b) by 814 days.

(21) Appl. No.: 12/582,927

(22) Filed: Oct. 21, 2009

(65) Prior Publication Data

US 2011/0091327 A1 Apr. 21, 2011

(51) Int. Cl.
*F01D 25/12* (2006.01)

(52) U.S. Cl. ..... 416/97 R; 416/92; 416/228

(58) Field of Classification Search ..... 416/92, 416/97 R, 228
See application file for complete search history.

(56) References Cited

U.S. PATENT DOCUMENTS

| | | | | |
|---|---|---|---|---|
| 4,768,922 | A | 9/1988 | Kozak et al. | |
| 5,261,789 | A | 11/1993 | Butts et al. | |
| 5,282,721 | A * | 2/1994 | Kildea | 416/97 R |
| 6,494,678 | B1 | 12/2002 | Bunker | |
| 6,565,324 | B1 | 5/2003 | Phillipsen et al. | |
| 6,869,270 | B2 | 3/2005 | Bunker et al. | |
| 7,118,329 | B2 | 10/2006 | Goodman | |
| 7,494,319 | B1 | 2/2009 | Liang | |
| 7,632,062 | B2 * | 12/2009 | Harvey et al. | 415/115 |
| 8,133,032 | B2 * | 3/2012 | Tibbott et al. | 416/235 |
| 8,246,307 | B2 * | 8/2012 | Cheong et al. | 416/97 R |
| 2008/0213098 | A1 | 9/2008 | Neef et al. | |

* cited by examiner

*Primary Examiner* — Ninh H Nguyen
(74) *Attorney, Agent, or Firm* — Cantor Colburn LLP

(57) ABSTRACT

A turbine blade includes a body having a leading edge, a trailing edge, a pressure side, a suction side, and a tip region, and a winglet arranged on the pressure side of the body in the tip region extending from a point in the tip region down stream of the leading edge to the trailing edge.

14 Claims, 4 Drawing Sheets

TURBINES AND TURBINE BLADE WINGLETS

BACKGROUND OF THE INVENTION

The subject matter disclosed herein relates to turbine engines and particularly to turbine blades.

Turbine blades are typically mounted on a rotor connected to a shaft that rotates in the turbine engine. Turbine blades are subjected to high temperatures that cause degradation of the blades during engine operation.

BRIEF DESCRIPTION OF THE INVENTION

According to one aspect of the invention, a turbine blade includes a body having a leading edge, a trailing edge, a pressure side, a suction side, and a tip region, and a winglet arranged on the pressure side of the body in the tip region extending from a point in the tip region down stream of the leading edge to the trailing edge.

According to another aspect of the invention, a turbine engine includes a rotor assembly, and a plurality of turbine blades arranged on the rotor assembly at least one blade having a leading edge, a trailing edge, a pressure side, a suction side, a tip region, and a winglet arranged on the pressure side of the body in the tip region extending from a point in the tip region down stream of the leading edge to the trailing edge.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
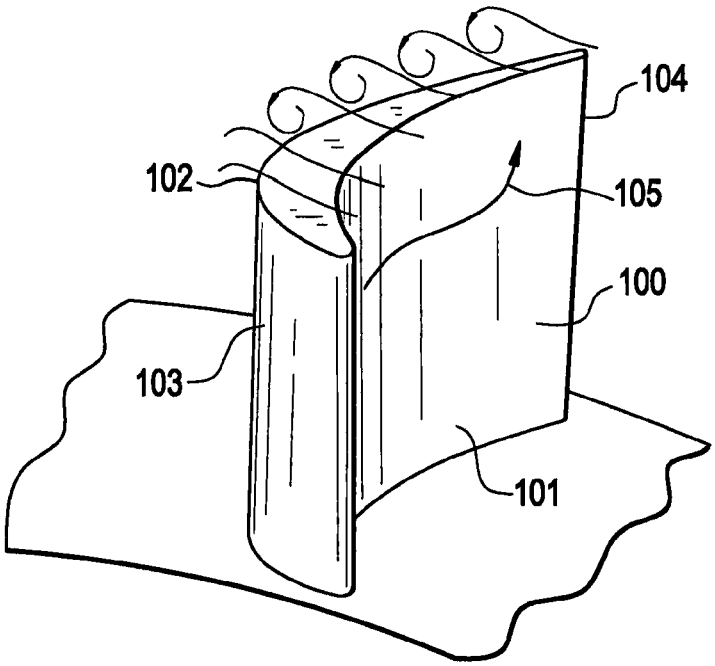
FIG. 1 Prior Art
FIG. 1 illustrates a prior art example of a turbine blade.

FIG. 1 illustrates a prior art example of a turbine blade 100. In operation, as the turbine blade 100 rotates, air flows from a pressure region 101 to a suction region 103 of the blade 100. The path of the air flow near a tip 102 of the blade is indicated by the arrow 105. The as the airflow approaches a trailing edge 104 of the blade, the airflow "leaks" over the tip 102. The amount of airflow that leaks over the tip 102 increases as the airflow approaches the trailing edge 104. The leakage of airflow over the tip 102 undesirably decreases the efficiency of the turbine blade, and increases the temperature of the tip 102. The increased temperature of the tip 102 region results in oxidation and wear of the tip 102 region material.

Figure 2:
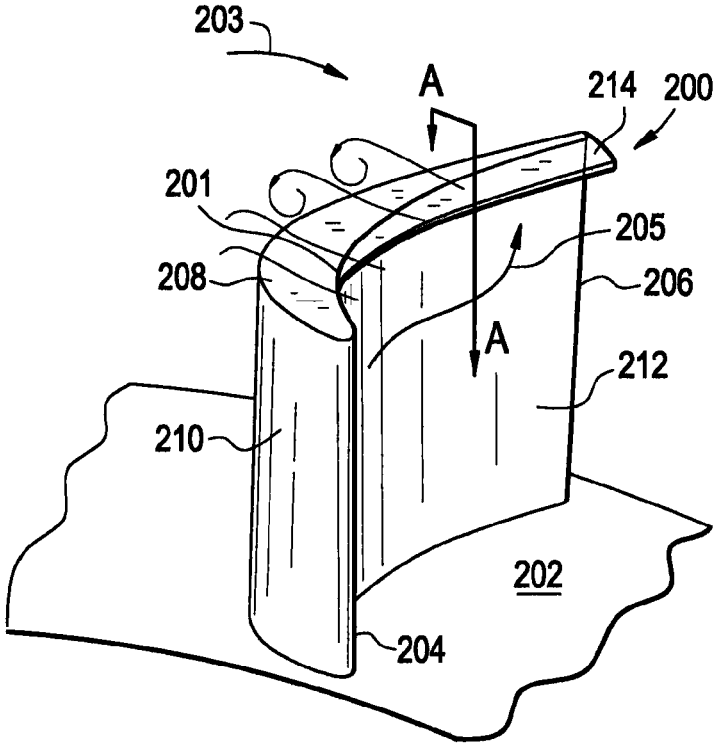
FIG. 2 illustrates an exemplary embodiment of a turbine blade.

FIG. 2 illustrates an exemplary embodiment of a turbine blade 200 connected to a portion of a moveable rotor 202 of a turbine. The turbine blade (blade) 200 has an airfoil shaped body with a leading edge 204, a trailing edge 206, a distal blade tip region (tip region) 208, a suction side 210 and a pressure side 212. A plurality of blades 200 arranged on the rotor 202 define an inner boundary of a flow duct of the turbine. An outer boundary of the flow duct is defined by a shroud (not shown). The blade 200 includes a winglet 214. The winglet 214 is arranged in the tip region 208 on the pressure side 212 of the blade 200. The winglet 214 extends from a point 201 on the tip region 208 that is downstream of the leading edge 204, to the trailing edge 214 of the blade 200, and is tapered from the trailing edge 214 to the point 201.

In operation, the rotor 202 rotates in a direction indicated by arrow 203. Air flows (indicated by arrow 205) along the pressure side 212 from the leading edge 204 to the trailing edge 206 and approaches the tip region 208, the air flow 205 is impeded by the winglet 214. The winglet 214 reduces the airflow 205 that leaks over the tip region 208 near the trailing edge 206. The reduction in airflow that leaks over the tip region 208 near the trailing edge 206 increases the efficiency of the blade 200, and reduces the heat transfer caused by the airflow in the tip region 208.

Figure 3:
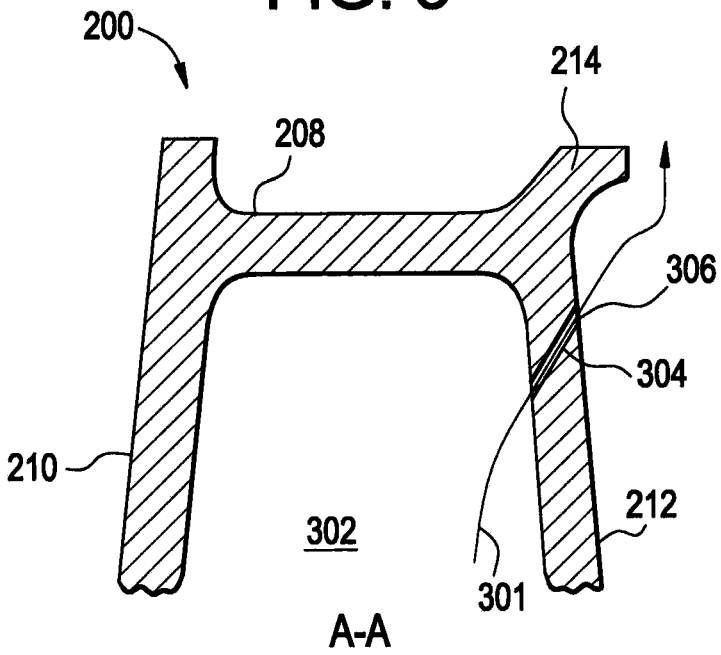
FIG. 3 illustrates a front cut-away view of an exemplary embodiment of the turbine blade along the line A-A of FIG. 2.

FIG. 3 illustrates a front cut-away view of an exemplary embodiment of the blade 200 along the line A-A in FIG. 2. The illustrated embodiment includes a cavity 302 in the blade 200 and a cooling passage 304 that is communicative with the cavity 302 and a port 306 disposed in the pressure side 212 of the blade 200. The cavity is defined by walls of the leading edge 204, the trailing edge 206, tip region 208, the suction side 210, and the pressure side 212. In operation, pressurized gas 301, such as, for example air or another type of gas enters the cooling passage 304 via the cavity 302 and is emitted from the port 306—cooling the winglet 214 and the tip region 208.

Figure 4:
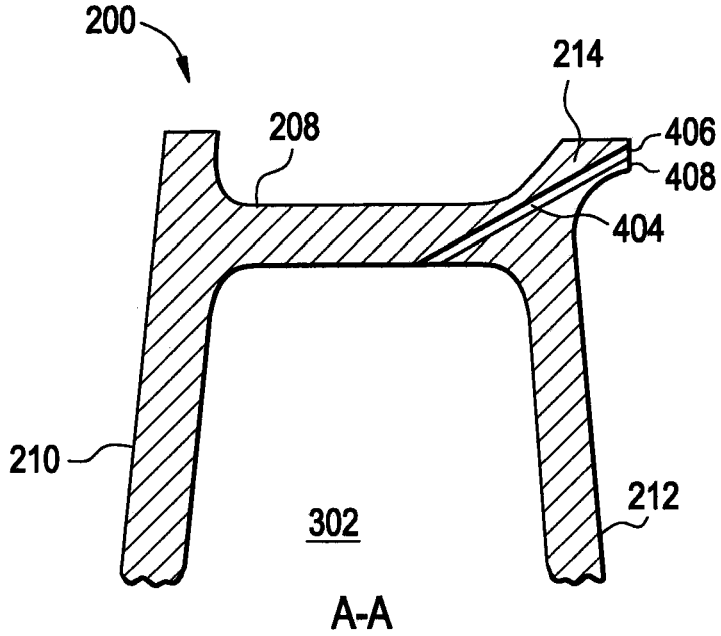
FIG. 4 illustrates a front cut-away view of another exemplary embodiment of the turbine blade along the line A-A of FIG. 2.

FIG. 4 illustrates a front cut-away view of another exemplary embodiment of the blade 200 along the line A-A in FIG. 2. The illustrated embodiment includes a cooling passage 404 that is communicative with the cavity 302 and a port 406 disposed on a pressure side edge 408 of the winglet 214. The cooling passage 404 operates in a similar manner to the cooling passage 304 described above.

Figure 5:
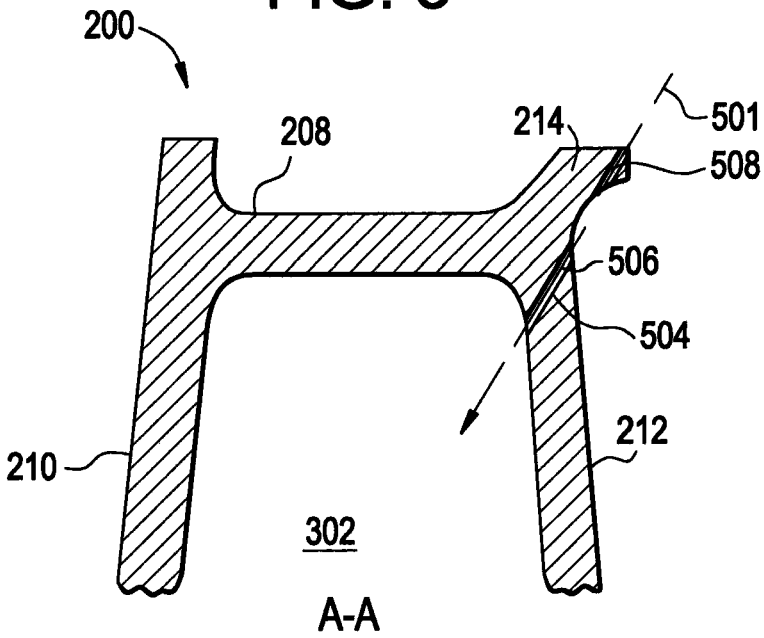
FIG. 5 illustrates a front cut-away view of another exemplary embodiment of the turbine blade along the line A-A of FIG. 2.

FIG. 5 illustrates a front cut-away view of another exemplary embodiment of the blade 200 along the line A-A in FIG. 2. The illustrated embodiment includes a cooling passage 504 that is communicative with the cavity 302 and a port 506 disposed on the pressure side 212 of the blade 200. The cooling passage 504 is fabricated by boring through a portion of the winglet 214 and the blade 200 along the line 501 resulting in the passage 504 and a passage 508 in the winglet 214. The boring may be performed by, for example, drilling. Boring through the winglet 214 allows the port 506 to be formed in proximity to the winglet 214 using a linear boring tool. The cooling passage 504 operates in a similar manner to the cooling passage 304 described above. In some embodiments, the passage 508 in the winglet 214 may be plugged to close the passage 508.

Figure 6:
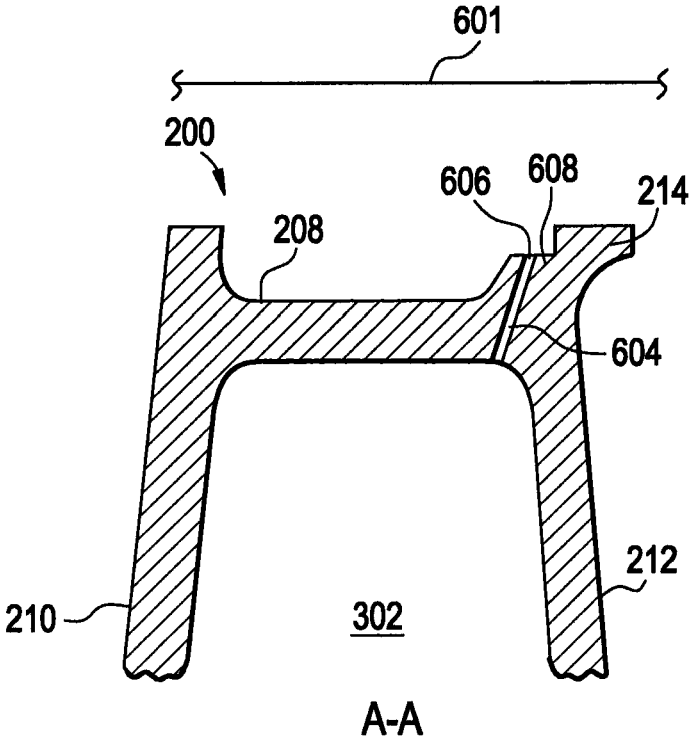
FIG. 6 illustrates a front cut-away view of another exemplary embodiment of the turbine blade along the line A-A of FIG. 2.

FIG. 6 illustrates a front cut-away view of another exemplary embodiment of the blade 200 along the line A-A in FIG. 2. The illustrated embodiment includes a cooling passage 604 that is communicative with the cavity 302 and a port 606. The port 606 disposed in a groove 608 that is formed in the winglet

214. The groove 608 offsets the port 606 radially inward from the outer radius of the blade 200. The offset of the port 606 discourages the obstruction of the port 606 if the blade 202 contacts a shroud 601 that surrounds the blades 200 and the rotor 202. The cooling passage 604 operates in a similar manner to the cooling passage 304 described above.

Figure 7:
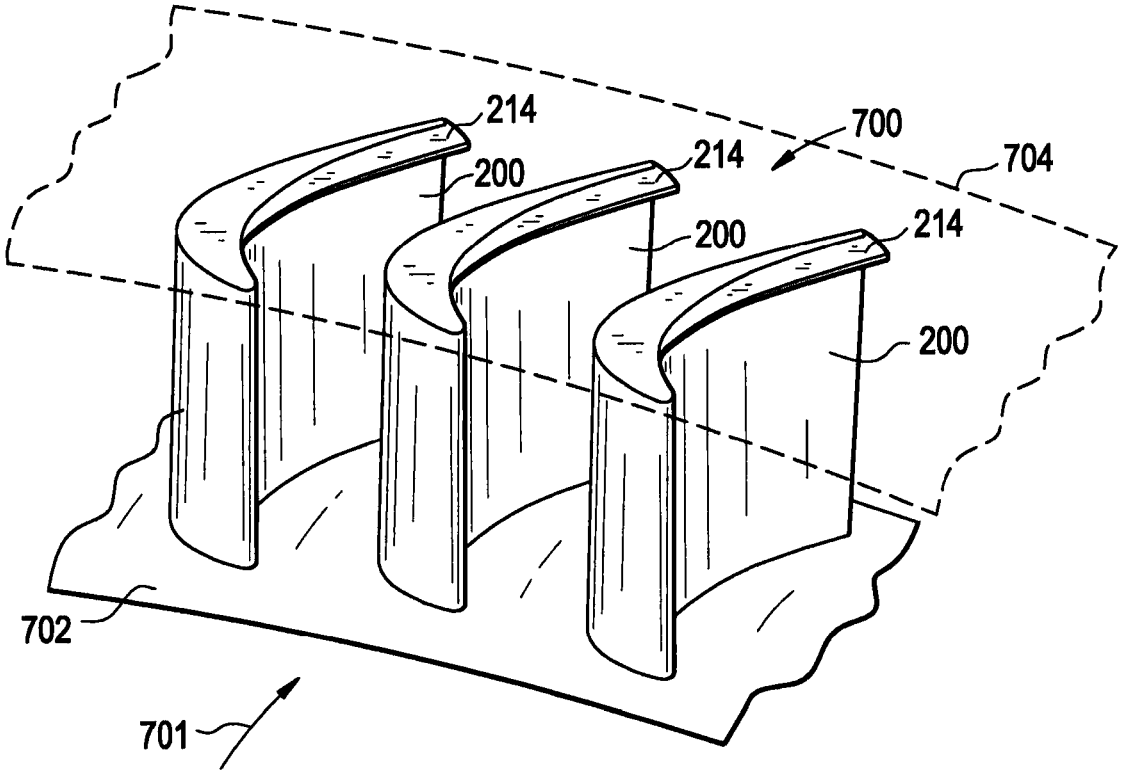
FIG. 7 illustrates a partially cut-away perspective view of a portion of a turbine engine.

FIG. 7 illustrates a partially cut-away perspective view of a portion of a turbine engine 700. The turbine engine 700 includes a plurality of blades 200 having the winglets 214 arranged on a rotor assembly 702 enclosed by a shroud 704. The direction of the gas flow path of the turbine engine 700 is shown by arrow 701.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbine blade comprising:

a body having a leading edge, a trailing edge, a pressure side, a suction side, and a tip region; and a winglet arranged on the pressure side of the body in the tip region extending from one end of the winglet at a point in the tip region downstream of the leading edge of the body to an opposite end of the winglet at the trailing edge of the body, the winglet tapered from the trailing edge to the point in the tip region, such that a width of the winglet at the trailing edge is greater than a width of the winglet at the point in the tip region, wherein the turbine blade includes an interior cavity and a cooling passage communicative with the interior cavity and a port in the pressure side of the body, the port disposed radially inwardly on the turbine blade relative to the winglet, and the turbine blade includes a second passage in the winglet aligned co-linearly with the cooling passage.

2. The turbine blade of claim 1, wherein the width of the winglet at the trailing edge is greater than a width of the winglet at any other location from the trailing edge to the point in the tip region.

3. The turbine blade of claim 1, wherein the blade is airfoil shaped.

4. The turbine blade of claim 1, wherein the turbine blade is arranged on a rotor.

5. The turbine blade of claim 1, wherein the winglet is operative to direct airflow along the pressure side towards the trailing edge of the body.

6. The turbine blade of claim 1, wherein the port is operative to output pressurized gas received via the passage and the interior cavity.

7. A turbine engine including:

a rotor assembly; and a plurality of turbine blades arranged on the rotor assembly at least one blade having a leading edge, a trailing edge, a pressure side, a suction side, a tip region, and a winglet arranged on the pressure side of the body in the tip region of the body extending from one end of the winglet at a point in the tip region of the body downstream of the leading edge of the body to an opposite end of the winglet at the trailing edge of the body, the winglet tapered from the trailing edge to the point in the tip region, such that a width of the winglet at the trailing edge is greater than a width of the winglet at the point in the tip region, wherein each of the plurality of turbine blades includes an interior cavity and a cooling passage communicative with the interior cavity and a port in the pressure side, the port disposed radially inwardly on each of the plurality of turbine blades relative to the winglet, and each of the plurality of turbine blades includes a second passage in the win let aligned co-linearly with the cooling passage.

8. The engine of claim 7, wherein the width of the winglet is tapered from the trailing edge to the point in the tip region such that the width of the winglet at the trailing edge is greater than a width of the winglet at any other location along the body of the turbine blade.

9. The engine of claim 7, wherein each of the plurality of turbine blades is airfoil shaped.

10. The engine of claim 7, wherein each of the plurality of turbine blades is arranged on a rotor.

11. The engine of claim 7, wherein the winglet is operative to direct airflow along the pressure side towards the trailing edge of the body.

12. The engine of claim 7, wherein the port is operative to output pressurized gas received via the passage and the interior cavity.

13. A turbine blade comprising:

a body having a leading edge, a trailing edge, a pressure side, a suction side, and a tip region, a groove being located in the tip region, the body including an interior cavity, a passage communicative with the interior cavity, and a port disposed in the groove; and a winglet arranged on the pressure side of the body in the tip region extending from a point in the tip region downstream of the leading edge to the trailing edge.

14. A turbine engine including:

a rotor assembly; and a plurality of turbine blades arranged on the rotor assembly at least one blade having a leading edge, a trailing edge, a pressure side, a suction side, a tip region, and a winglet arranged on the pressure side of the body in the tip region of the body extending from one end of the winglet at a point in the tip region of the body downstream of the leading edge of the body to an opposite end of the winglet at the trailing edge of the body, the winglet tapered from the trailing edge to the point in the tip region, such that a width of the winglet at the trailing edge is greater than a width of the winglet at the point in the tip region, wherein each of the plurality of turbine blades includes a groove in the tip region and an interior cavity and a passage communicative with the interior cavity and a port disposed in the groove.

* * * * *